US008839653B2

(12) United States Patent
Roman, Jr. et al.

(10) Patent No.: US 8,839,653 B2
(45) Date of Patent: Sep. 23, 2014

(54) CRIMPING TOOL CONNECTOR LOCATOR

(75) Inventors: Richard M. Roman, Jr., New Hampton, NH (US); John D. Lefavour, Litchfield, NH (US); Thomas R. Faucher, Manchester, NH (US); Alan D. Beck, Bow, NY (US); Mark A. Chiasson, Merrimack, NH (US); Jennifer M. Peterson, Littleton, NH (US); John W. Ayer, Milford, NH (US); Richard E. Robicheau, Litchfield, NH (US); Justin Lloyd Parker, Billerica, MA (US); Bernard P. Vachon, Litchfield, NH (US); Jerry Heckman, New Hampton, NH (US)

(73) Assignee: Hubbell Incorporated, Shelton, CT (US)

( * ) Notice: Subject to any disclaimer, the term of this patent is extended or adjusted under 35 U.S.C. 154(b) by 565 days.

(21) Appl. No.: 12/473,721

(22) Filed: May 28, 2009

(65) Prior Publication Data

US 2009/0313820 A1 Dec. 24, 2009

Related U.S. Application Data

(60) Provisional application No. 61/130,672, filed on Jun. 2, 2008, provisional application No. 61/133,397, filed on Jun. 27, 2008.

(51) Int. Cl.

| | |
|---|---|
| ***B21D 37/06*** | (2006.01) |
| ***H01R 43/042*** | (2006.01) |
| ***B25B 27/10*** | (2006.01) |
| ***B25B 27/14*** | (2006.01) |

(52) U.S. Cl.

CPC ..... *H01R 43/0428* (2013.01); *B25B 27/10* (2013.01); *B25B 27/146* (2013.01)

USPC ..... 72/456; 72/416; 72/409.16; 29/751

(58) Field of Classification Search

USPC ..... 29/751, 758, 739; 72/409.14, 461, 72/453.16; 227/51–53, 111, 147

See application file for complete search history.

(56) References Cited

U.S. PATENT DOCUMENTS

| | | | | |
|---|---|---|---|---|
| 2,693,218 | A | | 11/1954 | Freedom |
| 2,829,549 | A | | 4/1958 | Demler |
| 2,933,000 | A | | 4/1960 | Wood |
| 3,118,486 | A | | 1/1964 | Radocy |
| 3,199,334 | A | | 8/1965 | Holmes et al. |
| 3,326,029 | A | * | 6/1967 | Porter ..... 72/362 |
| 3,332,272 | A | * | 7/1967 | Tonchen ..... 72/409.19 |
| 3,504,417 | A | | 4/1970 | Filia |
| 3,571,890 | A | * | 3/1971 | Brehm et al. ..... 29/566.4 |
| 3,937,050 | A | | 2/1976 | Nicholson |
| 4,292,833 | A | * | 10/1981 | Lapp ..... 72/416 |

(Continued)

*Primary Examiner* — Minh Trinh

(74) *Attorney, Agent, or Firm* — Harrington & Smith

(57) ABSTRACT

Disclosed herein is a hydraulic tool working head guide. The hydraulic tool working head guide includes a main section having a general plate shape. The main section is adapted to be connected to an exterior surface of a hydraulic tool working head. The main section includes a slot having an open end at an edge of the main section and a closed end at a middle portion of the main section. The slot extends through a thickness of the main section. The closed end is adapted to be aligned with a receiving area of the hydraulic tool working head. The slot is adapted to substantially center a connector and/or a conductor in the receiving area.

22 Claims, 15 Drawing Sheets

(56) References Cited

U.S. PATENT DOCUMENTS

| | | | | | |
|---|---|---|---|---|---|
| 4,604,890 | A * | 8/1986 | Martin | 72/453.16 |
| 5,307,664 | A | 5/1994 | Homm | 72/401 |
| 5,335,530 | A * | 8/1994 | Homm | 72/402 |
| 5,924,322 | A | 7/1999 | Carveney | 72/409.14 |
| 6,125,682 | A | 10/2000 | Rzasa et al. | 72/412 |
| 6,227,030 | B1 * | 5/2001 | Lefavour et al. | 72/416 |
| 6,792,789 | B1 * | 9/2004 | Faucher | 72/456 |
| 6,820,326 | B1 | 11/2004 | Tarpill et al. | 29/751 |
| 7,124,619 | B1 * | 10/2006 | Lefavour et al. | 72/456 |

* cited by examiner

CRIMPING TOOL CONNECTOR LOCATOR

CROSS REFERENCE TO RELATED APPLICATION

This application claims priority under 35 U.S.C. §119(e) to U.S. provisional patent application No. 61/130,672 filed Jun. 2, 2008 and to U.S. provisional patent application No. 61/133,397 filed Jun. 27, 2008, which are hereby incorporated by reference in their entireties.

BACKGROUND

1. Field of the Invention

The invention relates to an electrical connector crimping tool and, more particularly, to an electrical connector locator for a crimping tool.

2. Brief Description of Prior Developments

Referring to FIG. 1, there is shown a perspective view of a conventional electrical connector crimping tool 10. In this embodiment the tool 10 is a battery operated hydraulic crimping tool. However, the tool could be a non-battery operated tool, such as a remotely supplied hydraulic tool or a self-contained hydraulic tool. The tool 10 generally comprises a working head 12, a main section 14 and a removable rechargeable battery 16. The main section 14 has a housing 18 forming a handle 20. Located inside the housing 18 is a battery powered motor 22 connected to a hydraulic pump 24. A frame 26 is provided forming a hydraulic system among the pump 24, a hydraulic fluid reservoir 28, and a rear end of the ram 30 (see FIG. 2) of the working head 12. Triggers 32 are provided for actuating the motor 22, and alternatively retracting the ram 30 from a forward position.

Referring also to FIG. 2, the working head 12 is a four (4) point crimping head with a latch style type of frame (having a movable anvil piece 34 connected to the main frame 36, 37 by a hinge 38 and a removable lock pin 40). The four point crimping head has four indentors 42, 43, 44, 45 for indenting or crimping an electrical connector (on to a conductor, for example) from four sides. The first indentor 42 is connected to a Y or V frame member 46 which is attached to the front end of the ram 30. The second and third indentors 43, 44 are connected to jaws 48. The jaws 48 are adapted to slide up and down on the inside surfaces of the arms of the frame member 46. The fourth indentor is stationarily mounted on the anvil piece 34. The frame member 46 and jaws 48 are movably captured inside the two members 36, 37 of the main frame.

When the frame member 46 is moved forward by the ram 30, an electrical connector can be crimped between the two opposing indentors 42, 45. At the same time, the jaws 48 are wedged in an inward direction towards each other. This causes the second and third indentors 43, 44 to be moved inward towards each other to also crimp the electrical connector by the indentors 43, 44. Thus, the electrical connector is indented at four points by the four indentors 42-45.

In some circumstances, the electrical connector can be mis-crimped if the electrical connector is not properly centered relative to the four indentors 42-45. This could result in a failure of the working head 12. If the misalignment is not noticed by the user, and the user continued to operate the tool 10, the head 12 could become severely damaged and might not be able to function anymore.

SUMMARY

The foregoing and other problems are overcome, and other advantages are realized, by the use of the exemplary embodiments of this invention.

In accordance with one aspect of the invention, a hydraulic tool working head guide is disclosed. The hydraulic tool working head guide includes a main section having a general plate shape. The main section is adapted to be connected to an exterior surface of a hydraulic tool working head. The main section includes a slot having an open end at an edge of the main section and a closed end at a middle portion of the main section. The slot extends through a thickness of the main section. The closed end is adapted to be aligned with a receiving area of the hydraulic tool working head. The slot is adapted to substantially center a connector and/or a conductor in the receiving area.

In accordance with another aspect of the invention, a hydraulic tool working head is disclosed. The hydraulic tool working head includes a main frame and a guide. The main frame includes a first exterior side, a second exterior side, and a connector receiving area. The first exterior side is opposite the second exterior side. The connector receiving area extends between the first exterior side and the second exterior side. The guide is mounted on the first exterior side. The guide includes a connector receiving portion in positional agreement with the connector receiving area. The connector receiving portion is adapted to align an electrical connector in the receiving area.

In accordance with another aspect of the invention, a hydraulic tool working head guide is disclosed. The hydraulic tool working head guide includes a first section and a second section. The first section has an opening. The first section is adapted to be connected to a hydraulic tool working head. The second section includes at least one spring arm. The spring arm extends away from the first section. The spring arm is adapted to extend into a connector receiving area of the hydraulic tool working head. The spring arm is adapted to contact and substantially center a connector in the receiving area.

In accordance with another aspect of the invention, a hydraulic tool working head is disclosed. The hydraulic tool working head includes a main frame, a first indentor, a second indentor, and a coil. The main frame includes a first exterior side, a second exterior side, and a connector receiving area. The first exterior side is opposite the second exterior side. The connector receiving area extends between the first exterior side and the second exterior side. The first indentor is at the receiving area. The first indentor is movably connected to the main frame. The first indentor includes a first opening. The second indentor is at the receiving area. The second indentor is movably connected to the main frame. The second indentor comprises a second opening. The coil extends through the first opening and the second opening. The coil is adapted to center an electrical connector in the receiving area.

In accordance with another aspect of the invention, a method of assembling a hydraulic tool working head assembly is disclosed. A hydraulic tool working head comprising an electrical connector receiving area is provided. A guide is attached to a first outer surface of the hydraulic tool working head. The guide includes a main section having a general plate shape and a slot. The slot extends from a side edge of the main section. The slot includes a closed end at a middle portion of the main section. The closed end is adapted to be aligned with the electrical connector receiving area. The slot is adapted to substantially center an electrical connector in the electrical connector receiving area.

In accordance with another aspect of the invention, a method of manufacturing a hydraulic tool working head guide is disclosed. A first section having a general plate shape is provided. The first section is adapted to be connected to an exterior surface of a hydraulic tool working head. A first receiving area is provided at the first section. The first receiving area includes an open end at an edge of the first section and a closed end at a middle portion of the first section. The first receiving area extends through a thickness of the first section. The closed end is adapted to be aligned with a connector receiving area of the hydraulic tool working head. The first receiving area is adapted to substantially center a connector in the connector receiving area.

BRIEF DESCRIPTION OF THE DRAWINGS

The foregoing aspects and other features of the invention are explained in the following description, taken in connection with the accompanying drawings, wherein.

DETAILED DESCRIPTION

Figure 3:
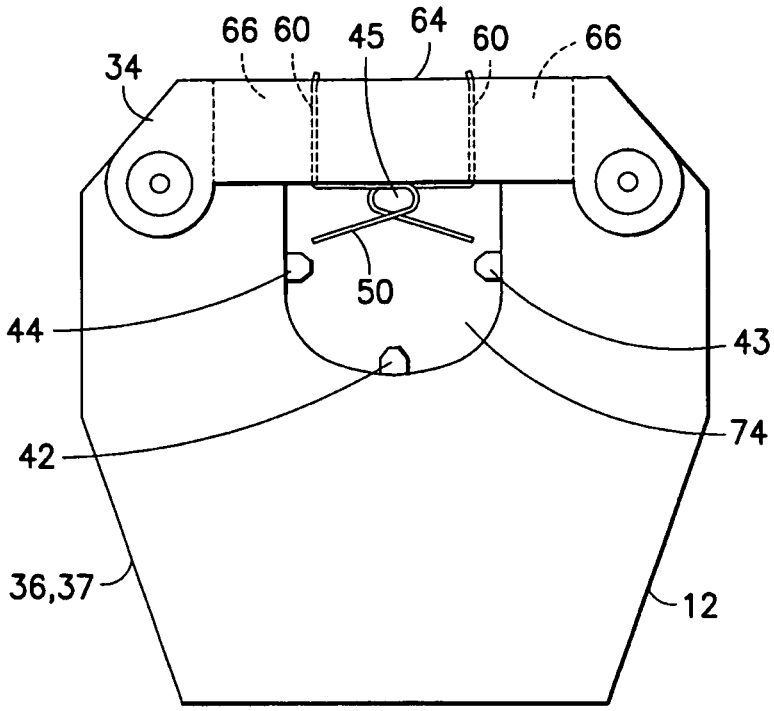
FIG. 3 is a side view of a working head assembly incorporating features of the invention.
Figure 4:
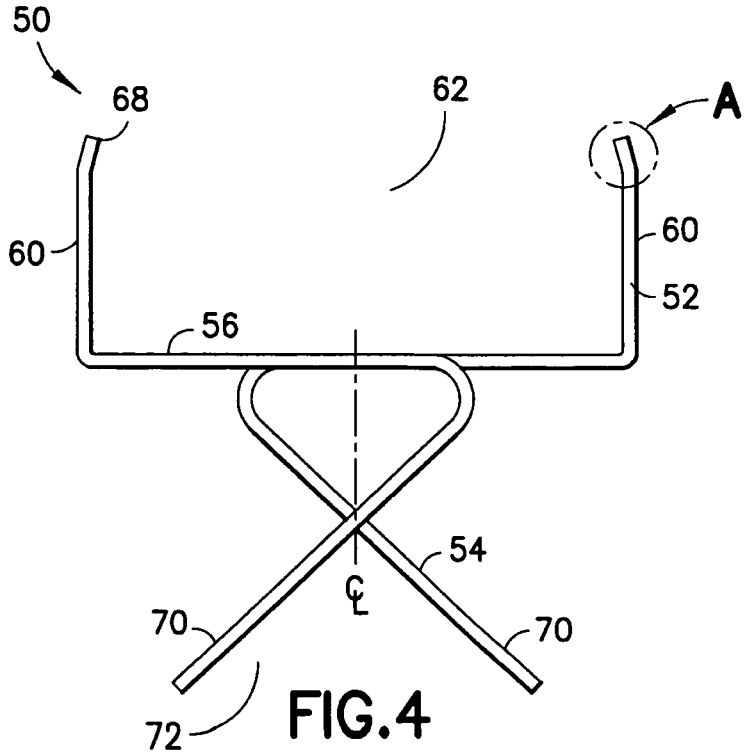
FIG. 4 is a side view of a working head guide used in the working head assembly shown in FIG. 3.
Figure 5:
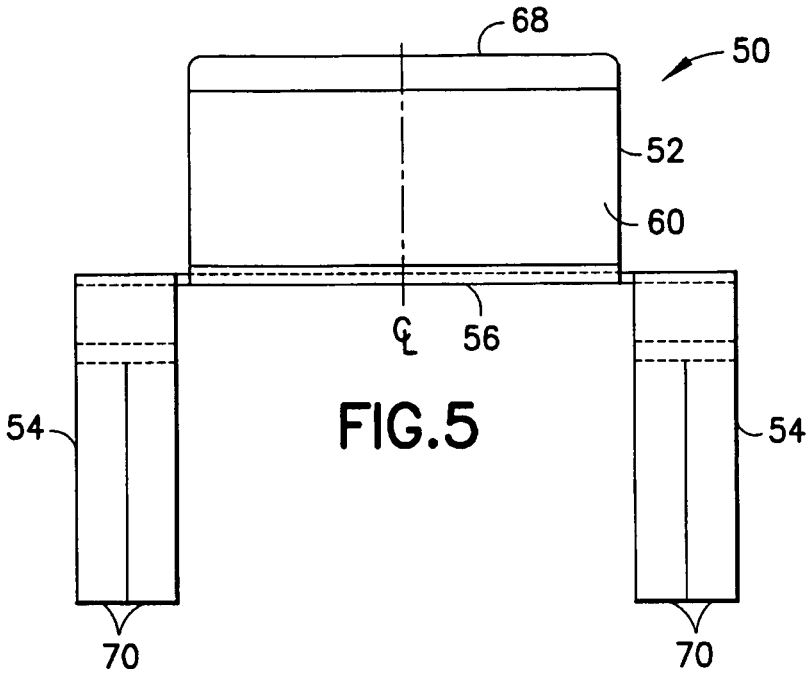
FIG. 5 is a front view of the working head guide shown in FIG. 4.
Figure 6:
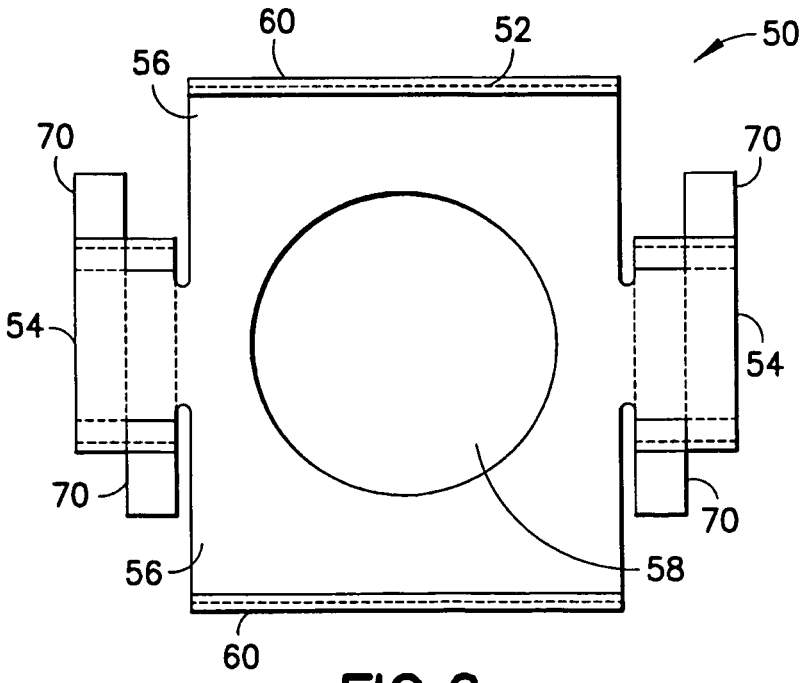
FIG. 6 is a top view of the working head guide shown in FIG. 4.

Referring to FIG. 3, there is shown a side view of the working head 12, but with the addition of another component to form a new type of tool (or working head assembly) incorporating features of the invention. Although the invention will be described with reference to the exemplary embodiments shown in the drawings, it should be understood that the invention can be embodied in many alternate forms of embodiments. In addition, any suitable size, shape or type of elements or materials could be used.

Figure 7:
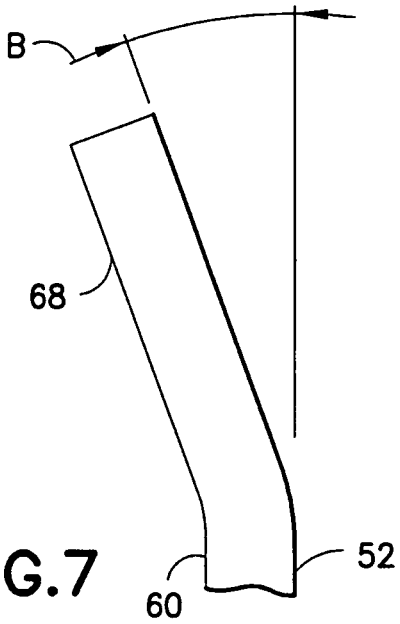
FIG. 7 is an enlarged view of area A of the working head guide shown in FIG. 4.
Figure 8:
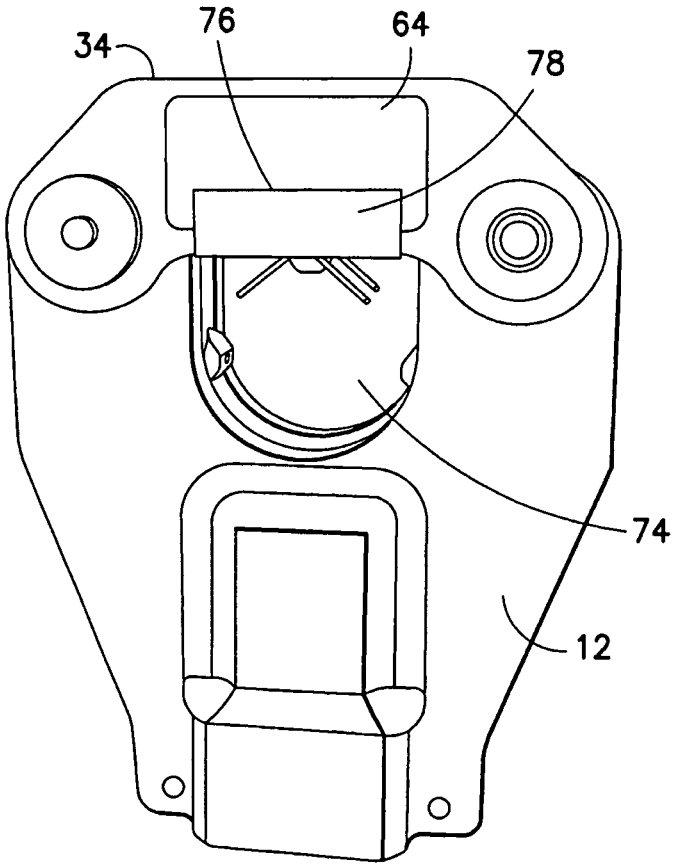
FIG. 8 is a perspective view of a working head assembly in accordance with another embodiment of the invention.
Figure 9:
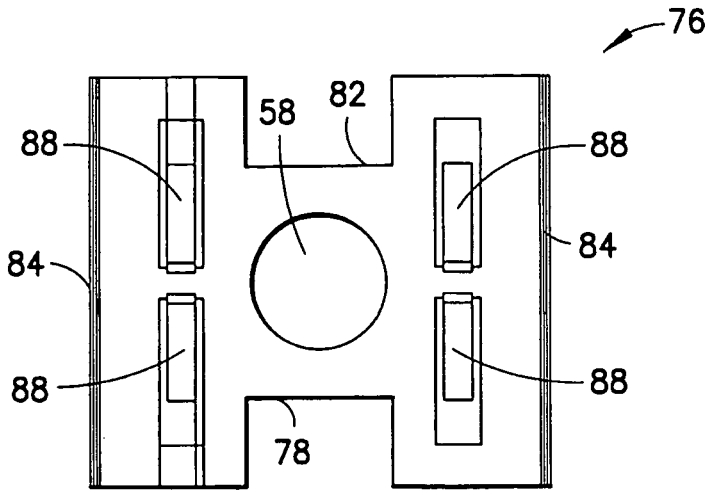
FIG. 9 is a top view of a working head guide used in the working head assembly shown in FIG. 8.
Figure 10:
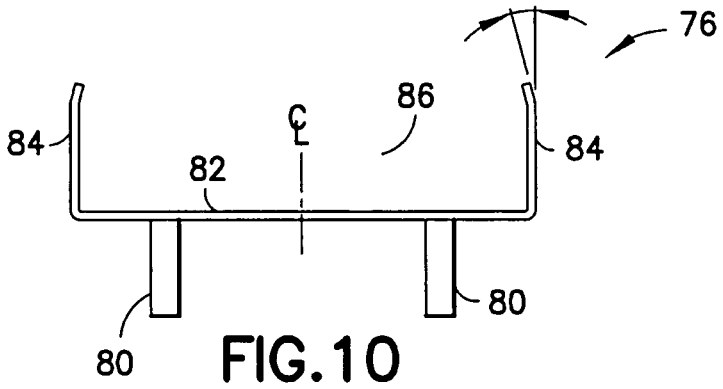
FIG. 10 is a side view of the working head guide shown in FIG. 9.
Figure 11:
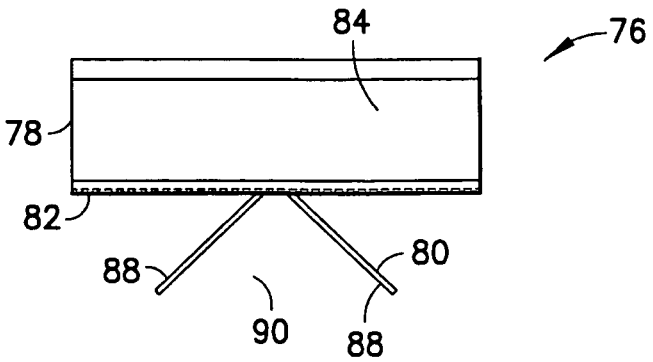
FIG. 11 is a front view of the working head guide shown in FIG. 9.

Referring also to FIGS. 4-7, the additional component comprises a guide 50. In this embodiment the guide 50 is a one piece member made from flat sheet metal which has been cut and formed into the shape shown. However, in alternate embodiments the guide could comprise more than one member, could comprise any suitable type of material(s), and/or could be formed by any suitable manufacturing process. The guide 50 generally comprises a first section 52 and two second sections 54. The first section 52 has a general C or U shaped cross section. The first section 52 is sized and shaped to clip onto the anvil piece 34. The first section comprises a base 56 with a hole 58 to accommodate the fourth indentor 45. The base is located against the inward facing side of the anvil piece 34. The first section 52 has two cantilevered arms 60. The arms 60 extend in a first direction and form a receiving space 62 for receiving a center portion 64 of the anvil piece 34. The arms 60 extend outward in the slots 66 in the anvil piece 34. As seen in FIG. 7, which is an enlarged view of area A in FIG. 4, the distal ends of the arms 60 are angled by an angle B. This allows the ends 68 to clip onto the center portion 64 in a general spring clip fashion. However, in alternate embodiments, any suitable type of attachment means could be provided.

Each of the second sections 54 comprise a pair of cantilevered spring arms 70 which extend in a second direction generally opposite the first direction. Each pair of spring arms 70 extend away from the base 56 in opposite directions relative to each other and are bent back to form a general crossing profile as shown best in FIG. 4. This forms a receiving area 72 for each pair of arms 70 which is adapted to contact the electrical connector in receiving area 74 (see FIG. 3) of the working head and help keep the connector (and the conductor) substantially centered in the area 74 during crimping.

Referring now to FIGS. 8-11, an alternate embodiment of the invention is shown. In this embodiment the working head 12 is provided with a guide 76. The guide 76 is a one piece member made from flat sheet metal which has been cut and formed into the shape shown. However, in alternate embodiments the guide could comprise more than one member, could comprise any suitable type of material (s), and/or could be formed by any suitable manufacturing process. The guide 76 generally comprises a first section 78 and two second sections 80. The first section 78 has a general C or U shaped cross section. The first section 78 is sized and shaped to clip onto the anvil piece 34. The first section comprises a base 82 with a hole 58 to accommodate the fourth indentor 45. The base is located against the inward facing side of the anvil piece 34. The first section 78 has two cantilevered arms 84. The arms 84 extend in a first direction and form a receiving space 86 for receiving the center portion 64 of the anvil piece 34. In this embodiment, rather than extending through the slots 66, the arms 84 extend along the outside sides of the center portion 64 as shown best in FIG. 8.

Each of the second sections 80 comprise a pair of cantilevered spring arms 88 which extend in a second direction generally opposite the first direction. Each pair of spring arms 88 extend away from the base 82 in opposite directions relative to each other, but are not bent back and, thus, form a general V shape, as shown best in FIG. 11, on opposite sides of the guide. This forms a receiving area 90 for each pair of arms 88 which is adapted to contact the electrical connector in the receiving area 74 (see FIG. 8) of the working head 12 and help keep the connector substantially centered in the area 74 during crimping. This design uses a spring steel locator to connect to the top of the latch. The V arms can deform when a large connector is crimped. After the connector is removed, the arms return to the original position.

Figure 1:
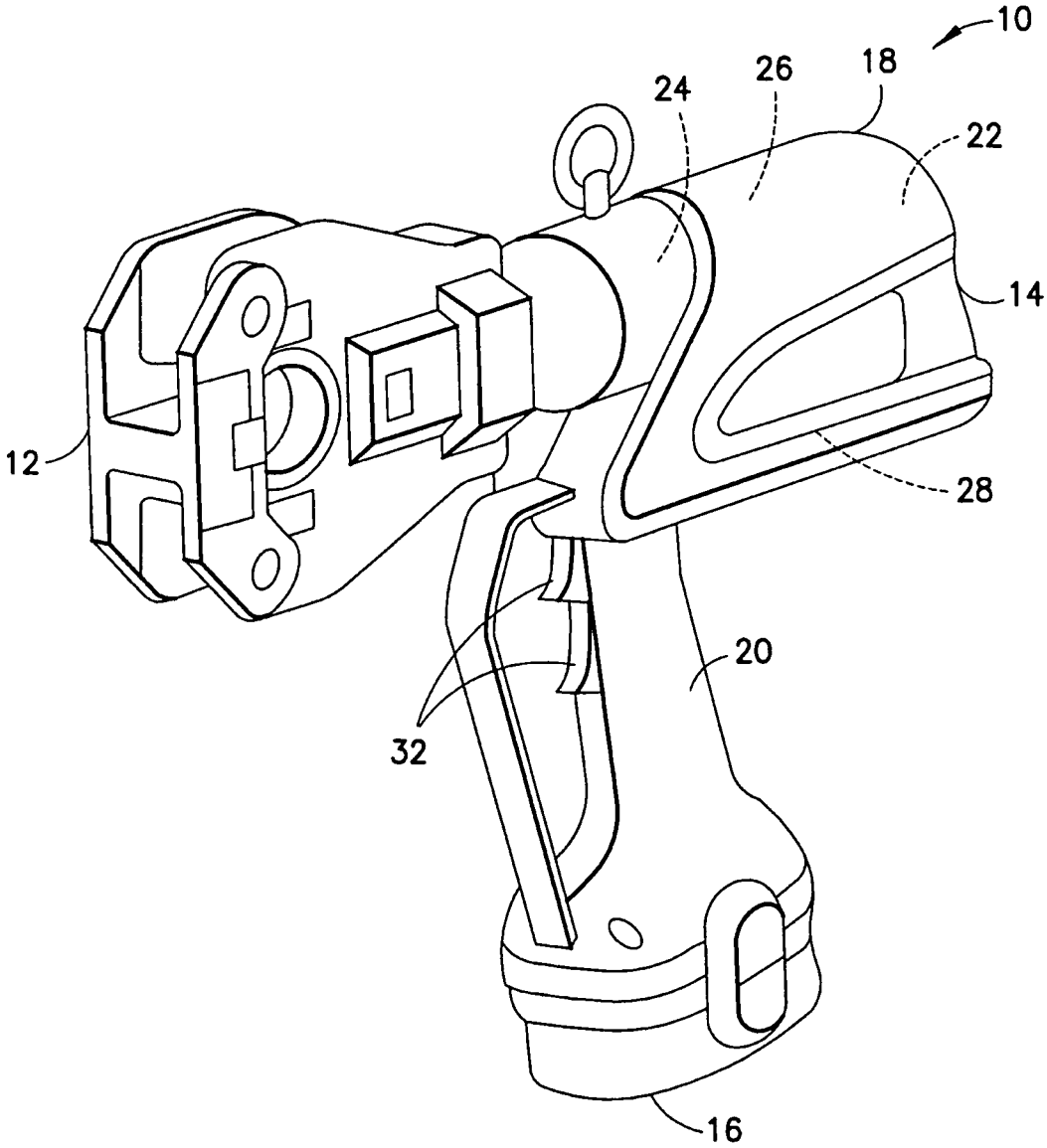
FIG. 1 PRIOR ART
FIG. 1 is a perspective view of a conventional electrical connector crimping tool.
Figure 2:
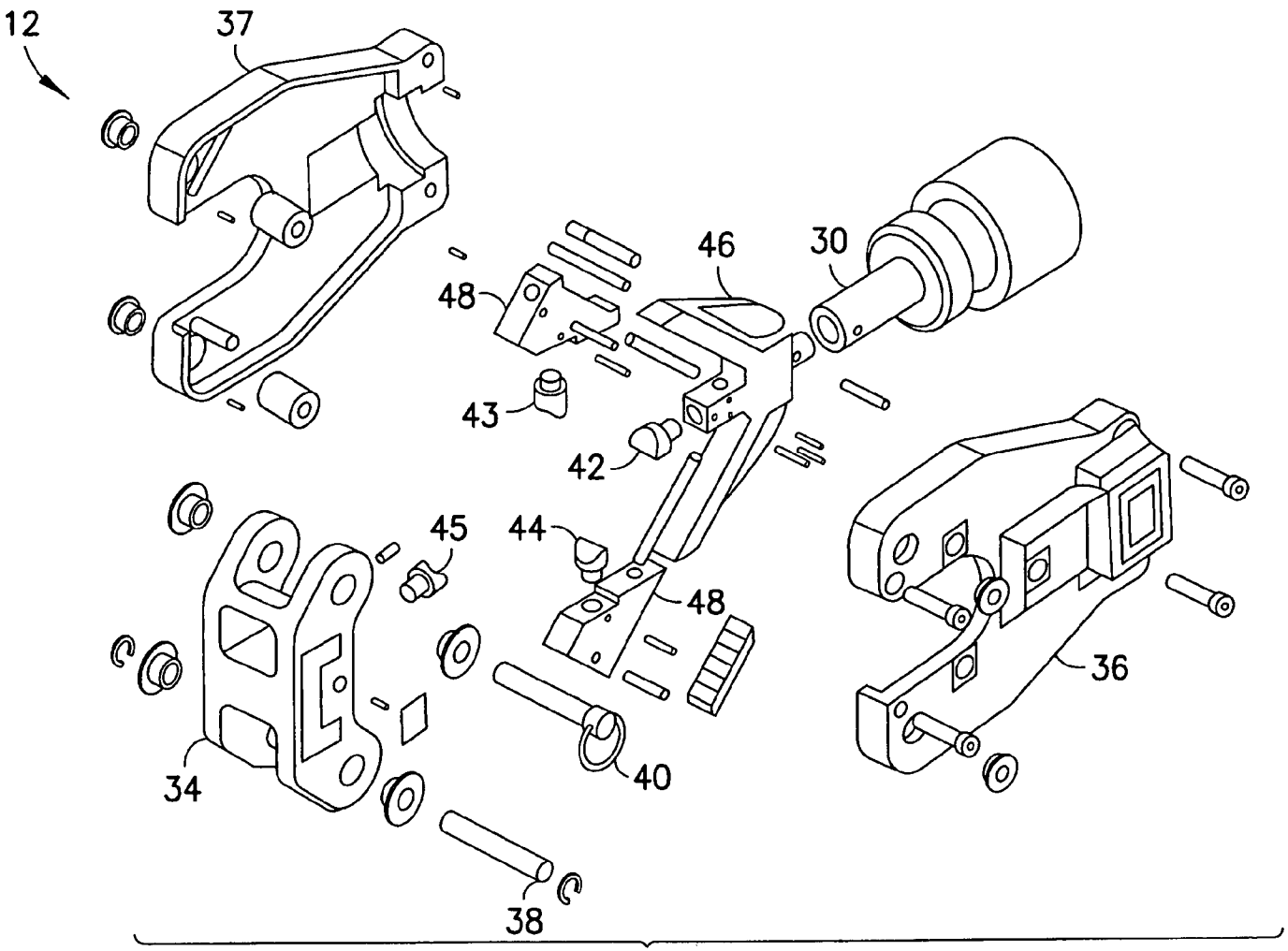
FIG.2 PRIOR ART
FIG. 2 is an exploded perspective view of the conventional electrical connector crimping tool shown in FIG. 1.
Figure 12:
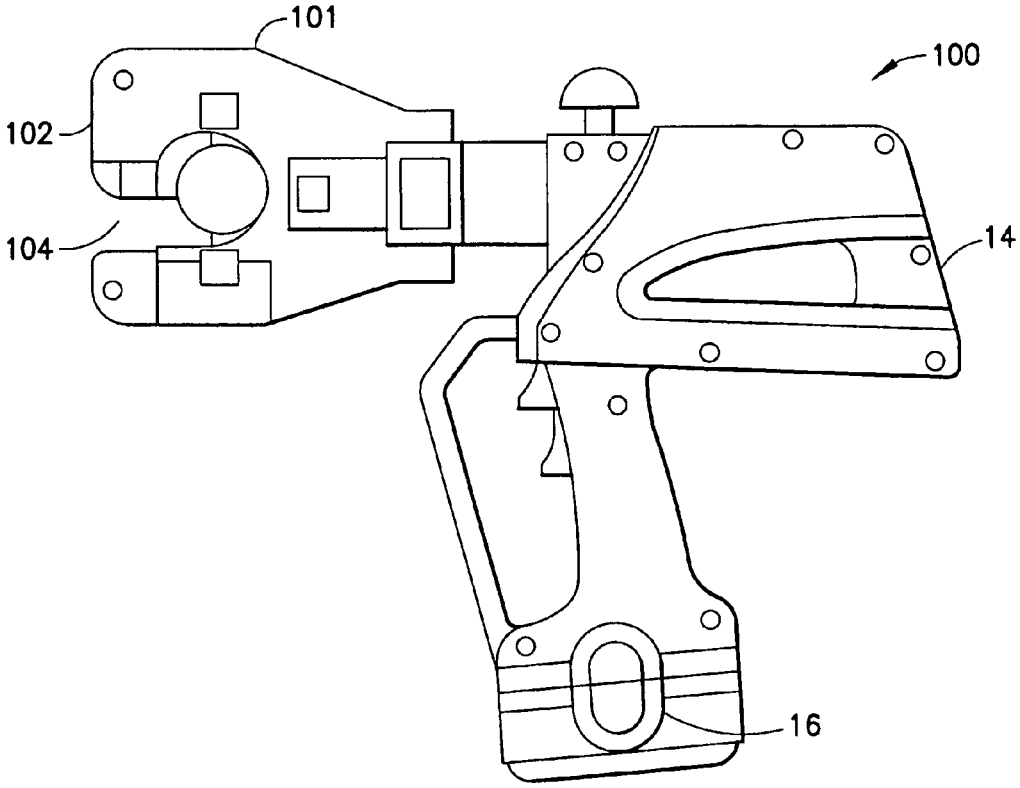
FIG. 12 PRIOR ART
FIG. 12 is a side view of a conventional electrical connector crimping tool comprising a working head with a "C" type frame.

Referring also to FIG. 12, a side view of another type of conventional crimping tool 100 is shown. The tool 100 includes a working head 101, the main section 14, and the battery 16. The working head 101 is a four point crimping tool similar to the tool 10 shown in FIG. 1. However, this type of tool has a working head with a "C" style type of frame rather than a latch style type of frame. The inner workings of the working head are the same as that shown in FIG. 2, but the frame does not have a pivotable anvil piece. Instead, the two mirror image main frame members of the working head 101 form a fixed anvil section 102 having a connector entry/exit slot 104.

Figure 13:
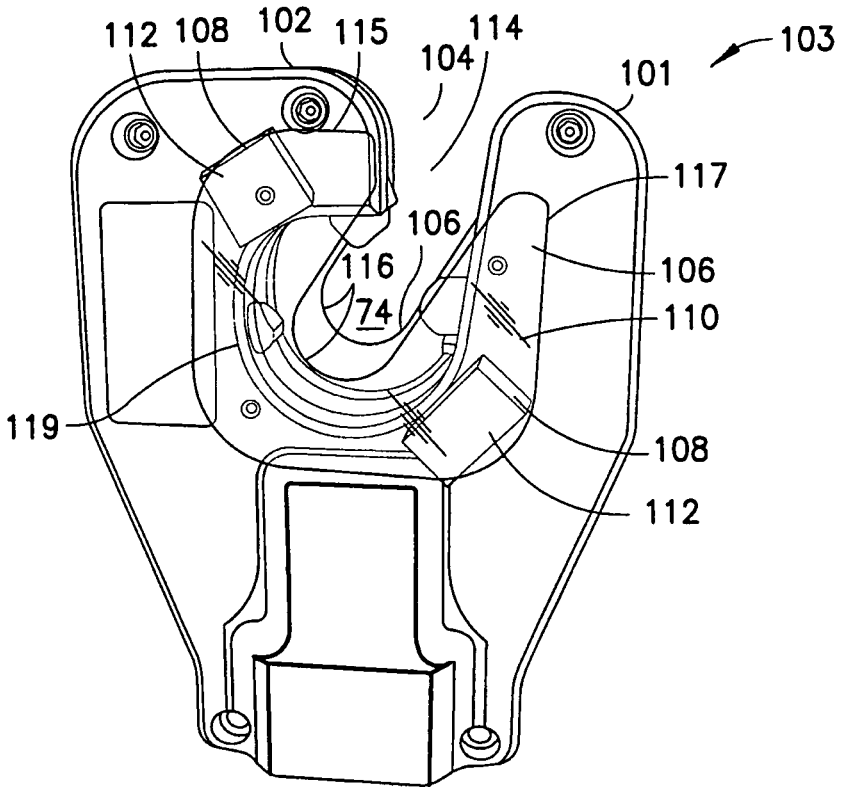
FIG. 13 is a perspective view of a working head assembly in accordance with another embodiment of the invention.

Referring also to FIG. 13, there is shown a hydraulic tool working head assembly 103 comprising the working head 101 with two guides 106 comprising features of the invention. The opposite exterior sides of the frame of the working head 101 have been provided with fasteners 108 proximate the connector receiving area 74. In this embodiment, the fasteners comprise a first part of a hooks and loops fastener, such as VELCRO®. However, in alternate embodiments any suitable type of fastener could be provided, such as screws for example. In this embodiment, two fasteners 108 are provided on each of the opposite exterior sides of the frame.

The guides 106 each comprise a one piece guide member 110, preferably made from clear plastic material, such as LEXAN®, and fasteners 112. However, in an alternate embodiment, the guide members could be made from a different type of material, such as sheet metal for example. The guide member (or main section) 110 has a general flat plate-like shape with a connector receiving slot 114. The slot (or connector receiving portion) 114 extends through a thickness of the main section 110 and has an entrance (or open end) at the slot 104. The entrance, or open end, may be between edges 115, 117 of the main section 110. The slot 114 also has a closed end 116 at the connector receiving area 74 (wherein the slot 114 is aligned, or in positional agreement, with the receiving area 74). The closed end 116 may be at a middle portion 119 of the main section 110. The fasteners 112 are adapted to connect to the fasteners 108. In this embodiment the fasteners 112 comprise a second part of a hooks and loops fastener, such as VELCRO®. Thus, the guide members 110 can be removably connected to the frame of the working head 101. In use, the guides 106 can help locate an electrical connector (and conductor) in a substantially centered location in the area 74 to prevent the connector from being incorrectly positioned.

Figure 14:
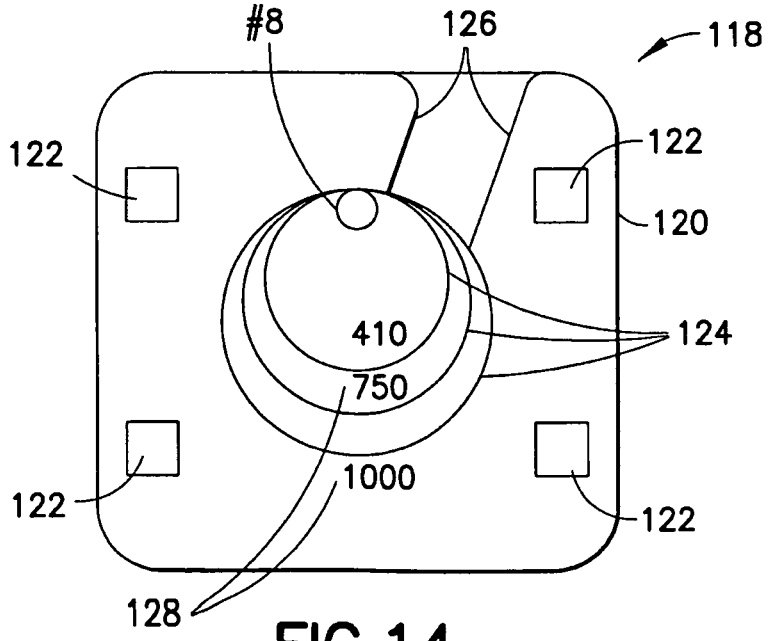
FIG. 14 is a front view of a working head guide in accordance with another embodiment of the invention.

Referring also to FIG. 14, another embodiment of the removable plate guide is shown. In this embodiment guide 118 comprises a flat plate guide member 120 and fasteners 122. The guide member 120 could be comprised of clear plastic material or sheet metal for example. The fasteners 122 comprise hook and loop type fasteners, such as VELCRO®. The guide member 120 has indicia or markings 124 and 126. The markings 124 are indicative of location where the plate 120 can be cut to match the size of the connector they are crimping, such as with tin snips or a saw for example. The connector sizes are indicated by markings 128 for example. The markings 126 indicate where the plate 120 can be cut for a "C" style type of working head frame rather than a latch style type of working head frame. For a latch style type of working head frame, the plate 120 need not be cut at locations 126. The markings 124, 126 might also include holes to make cutting or removing portions of the plate 120 easier. Thus, the single guide 118 can be adapted by a user for that user's particular size of connector being crimped, and the manufacturer does not need to provide a family of different size guides.

Figure 15:
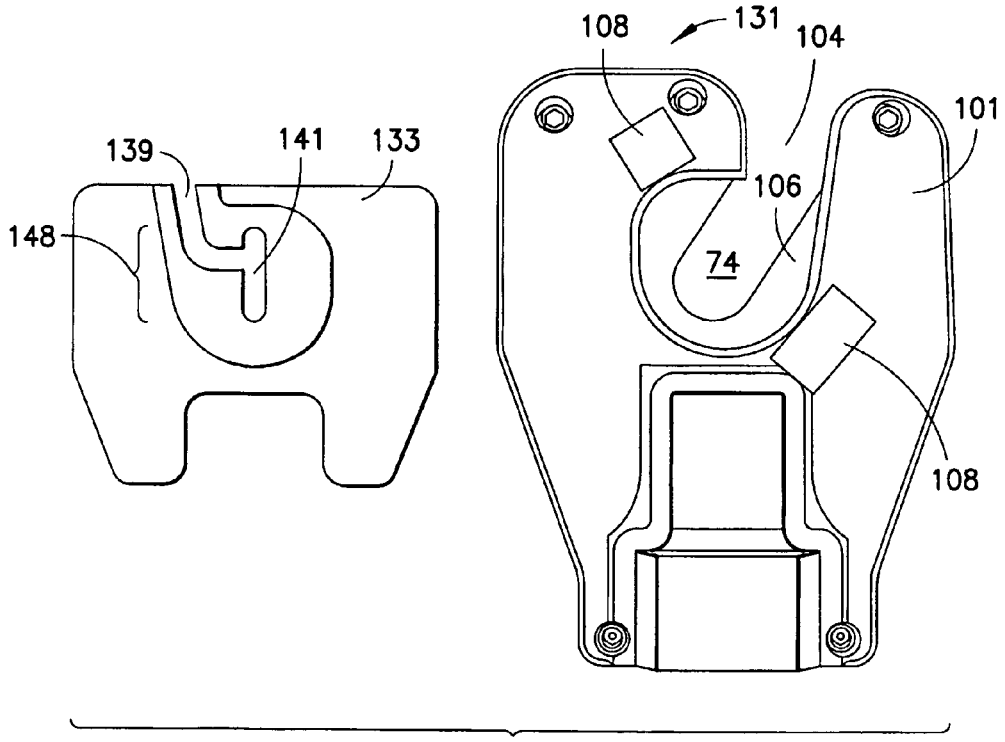
FIG. 15 is a front view of a working head assembly (with a guide removed) in accordance with another embodiment of the invention.

Referring also to FIG. 15, a hydraulic tool working head assembly 131 in accordance with another embodiment of the invention is shown. The hydraulic tool working head assembly 131 comprises the working head 101 and guides. In this embodiment, rather than providing the two guides 106 on the working head 101, the assembly 131 comprises the guide 106 on one exterior side (or outer surface) of the working head 101 and a different guide 133 on the other exterior side (see FIG. 17) of the working head 101.

Similar to the embodiment shown in FIG. 13, the opposite exterior sides of the frame of the working head 101 have been provided with fasteners 108 proximate the connector receiving area 74. In this embodiment, the fasteners comprise a first part of a hooks and loops fastener, such as VELCRO®. However, in alternate embodiments any suitable type of fastener could be provided, such as screws for example. In this embodiment, two fasteners 108 are provided on each of the opposite exterior sides of the frame. However, any suitable number of fasteners may be provided.

As described above, the guide 106 comprises the one piece guide member 110 and fasteners 112. The guide member 110 can be removably connected to one side of the frame of the working head 101 and can help locate an electrical connector in a substantially centered location in the area 74 to prevent the connector from being incorrectly positioned.

Figure 16:
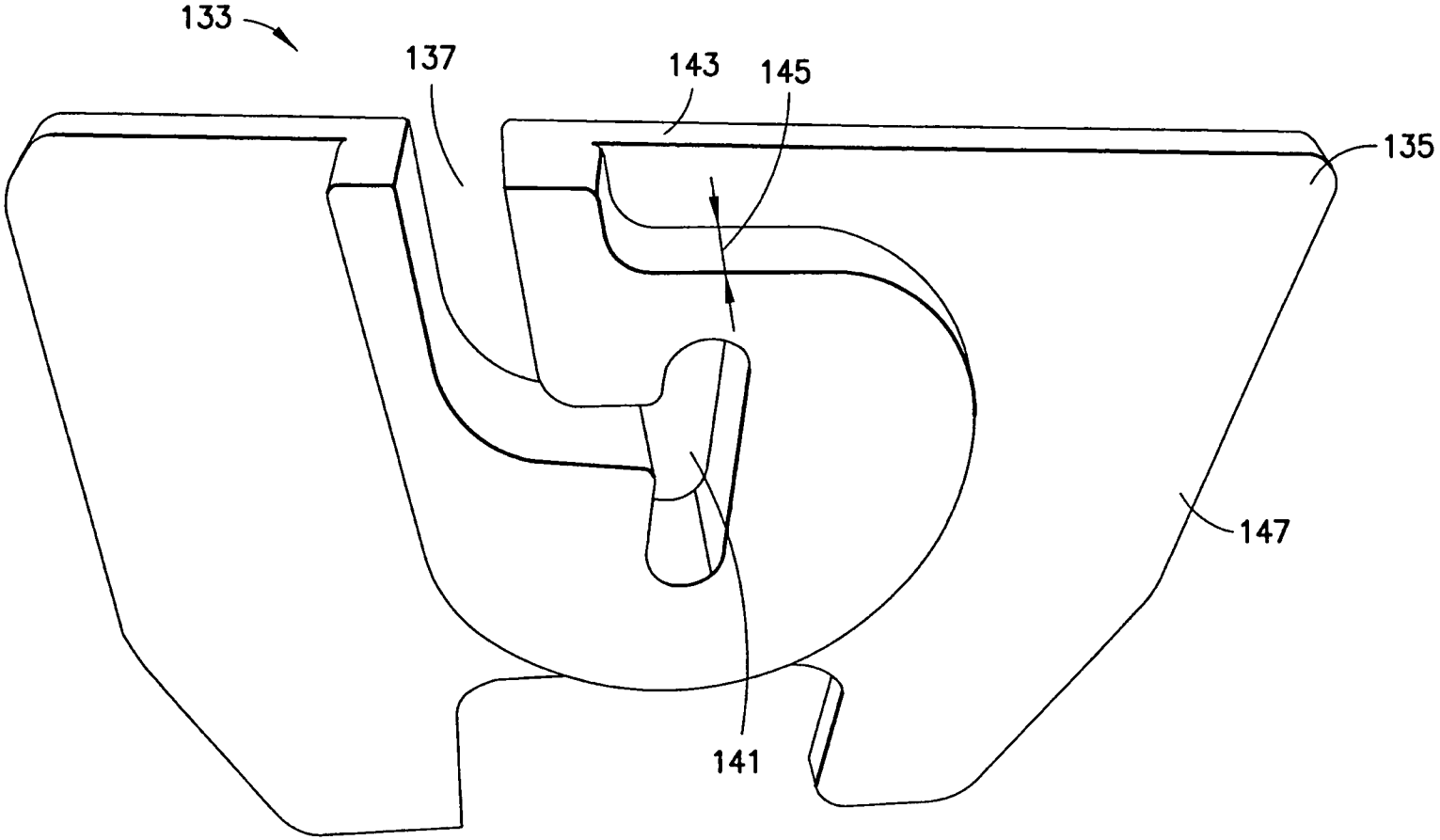
FIG. 16 is a perspective view of a working head guide used in the working head assembly shown in FIG. 15.
Figure 17:
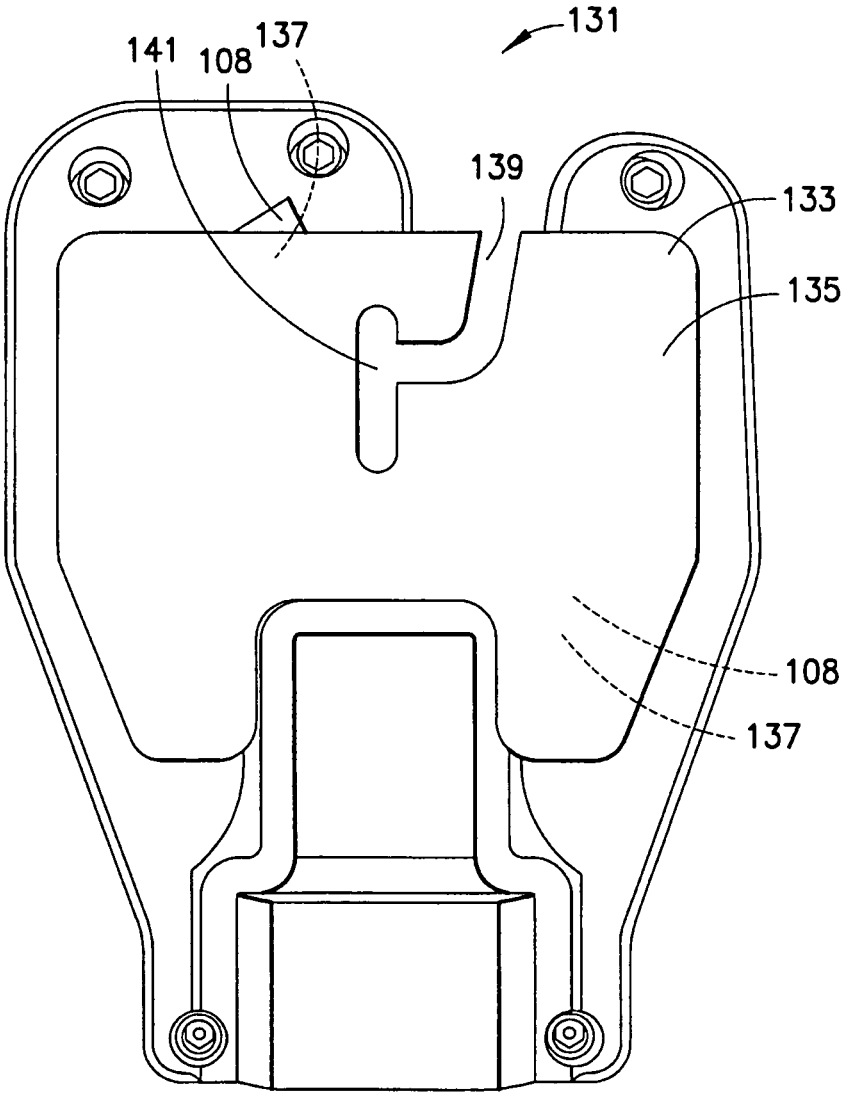
FIG. 17 is a front view of the working head assembly (in an assembled configuration) shown in FIG. 15.

Referring now also to FIGS. 16 and 17, the guide 133 comprises a one piece guide member 135 and fasteners 137. The guide member (or main section) 135 may be fabricated from a polycarbonate, however the guide member may be formed from any suitable material such as plastic material or sheet metal material for example. The guide member 135 has a general flat plate-like shape with a connector receiving slot 139. The slot (or connector receiving portion) 139 extends through a thickness of the guide member 135 and has an entrance (or open end) at the slot 104. The entrance, or open end, may be along edge 143 of the main section 135. The slot 139 also has a closed end 141 at the connector receiving area 74 (wherein the slot 139 is aligned, or in positional agreement, with the receiving area 74). However, in this embodiment, the closed end 141 comprises a substantial racetrack shape/configuration. The closed end 141 may be at a middle portion 149 of the main section 135. The closed end may also be oriented substantially perpendicular to the top edge 143 of the guide member 135. However, any suitable configuration or orientation may be provided. The guide member 135 may further comprise a thickened section 145 (shown in FIG. 16) proximate the slot 139. The thickened section 145 may extend from an interior facing side 147 of the guide member 135 and provide a reinforced and robust configuration for the slot 139. The thickened section 145 may be suitably sized and shaped to extend into the receiving area 74 and the slot 104 of the working head 101.

The fasteners 137 are adapted to connect to the fasteners 108. In this embodiment the fasteners 137 comprise a second part of a hooks and loops fastener, such as VELCRO®. Thus, the guide member 135 can also be removably connected to the frame of the working head 101. In use, the guides 106, 133 can help locate an electrical connector in a substantially centered location in the area 74 to prevent the connector from being incorrectly positioned.

It should be noted that guide 106 is not required and that some examples of the invention may provide only the single guide 133 at one exterior side of the working head 101. In another alternate embodiment, the guide 133 may be provided at both sides of the working head 101.

Additionally, it should be understood that the thickened section 145 is not required and any suitable configuration may be provided. Such as, a substantially uniform thickness configuration, for example.

Figure 18:
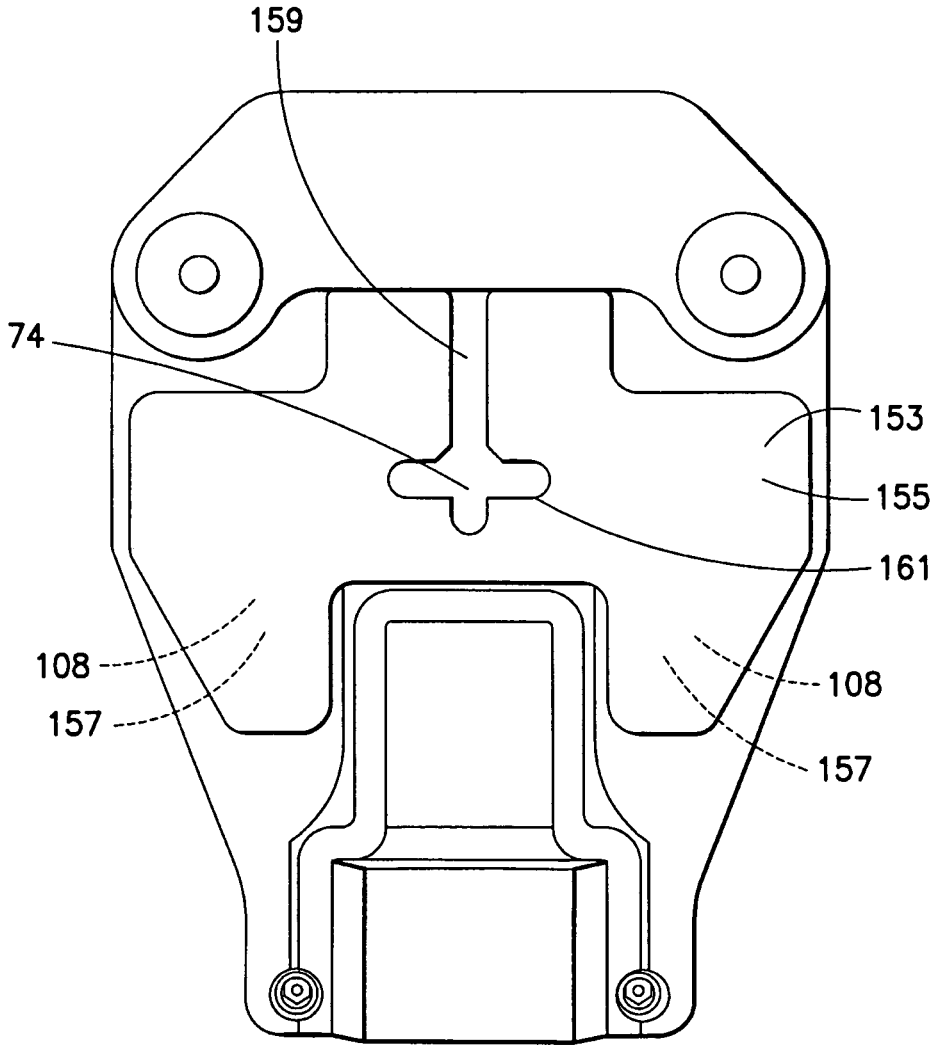
FIG. 18 is a front view of a working head assembly in accordance with another embodiment of the invention.

Referring also to FIG. 18 another embodiment of the removable plate guide is shown. In this embodiment guide 153 comprises a flat plate guide member 155 and fasteners 157. The guide 153 is similar to the guide 133. However, in this embodiment, the guide 133 is suitably sized and shaped to be attached and received by a working head with a latch style type of frame (having a pivotable anvil piece) rather than a "C" style type of frame.

Similar to the guide 133, the guide 153 comprises a one piece guide member 155 and fasteners 157. The guide member (or main section) 155 may be fabricated from a polycarbonate, however the guide member may be formed from any suitable material such as plastic material or sheet metal material for example. The guide member 155 has a general flat plate-like shape with a connector receiving slot 159. The slot (or connector receiving portion) 159 extends through a thickness of the guide member 155 and has a closed end 161 at the connector receiving area 74. Similar to the embodiment shown in FIG. 16, the guide member 155 may further comprise a thickened section 145 proximate the slot 159.

The fasteners 157 are adapted to connect to fasteners 108. In this embodiment the fasteners 137 comprise a second part of a hooks and loops fastener, such as VELCRO®. Thus, the guide member 155 can also be removably connected to the frame of the working head.

Similar to the embodiments above, the guide 153 may be attached to one side, or both sides, of the working head to help locate an electrical connector in a substantially centered location in the area 74 to prevent the connector from being incorrectly positioned.

Figure 19:
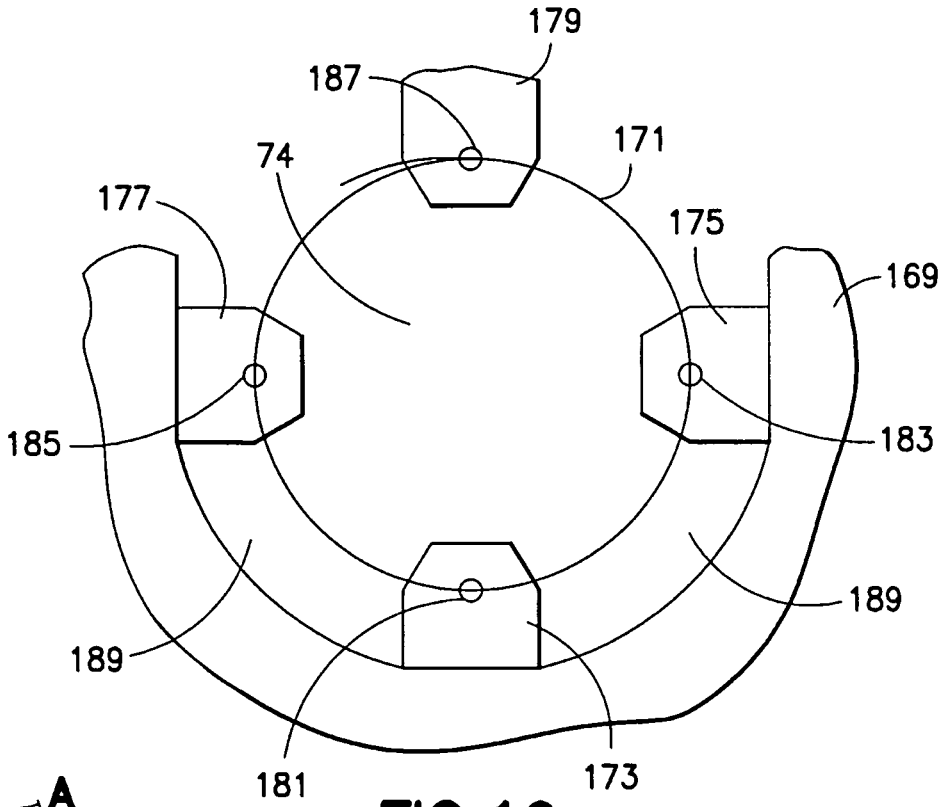
FIG. 19 is a partial front view of a working head assembly in accordance with another embodiment of the invention.
Figure 20:
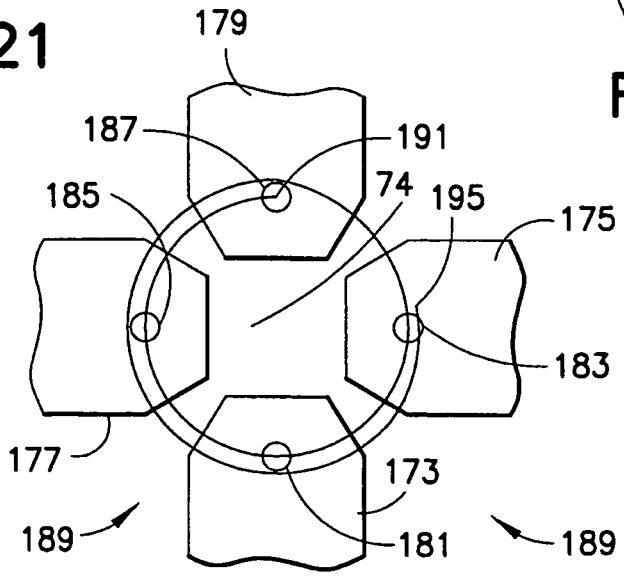
FIG. 20 is a partial front view of the working head assembly (in a closed configuration) shown in FIG. 19.

Referring also to FIGS. 19-20, another embodiment comprising a movable type guide is shown. In this embodiment, a guide (or coil) 171 is movably connected to indentors 173, 175, 177, 179 of a working head 169. The working head 169 may comprise any suitable type of frame such as a "C" style type of frame or a latch style type of frame, for example. The inner workings of the working head may be the same as that shown in FIG. 2, for example.

Each of the indentors 173, 175, 177, 179 comprises an opening 181, 183, 185, 187. The coil 171 extends through the openings 181, 183, 185, 187. In FIG. 19, the indentors are shown in an open position. During a connector crimping operation, the indentors 173, 175, 177, 179 move from the open position in FIG. 19 to a closed position as shown in FIG. 20. The coil is sized and shaped to continue to feed through the holes 181, 183, 185, 187 as the indentors get closer together.

The coil 171 is adapted to run through the indentors and block the connector from being mis-crimped in the corners (or mis-crimp area/zone) 189 of the tool and center the connector in the receiving area 74. The coil may, for example, push the connector away from the corners of the connector receiving area 74 during a crimping operation.

Figure 21:
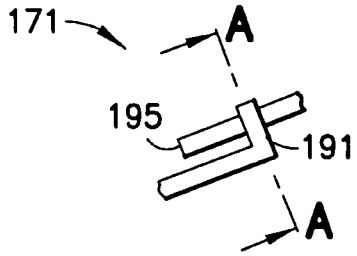
FIG. 21 is an enlarged view of a portion of a coil used in the working head assembly shown in FIG. 19.
Figure 22:
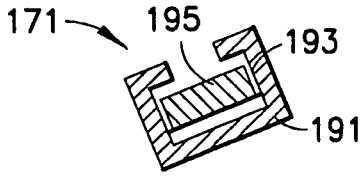
FIG. 22 is a cross section view of the coil shown in FIG. 21 taken along the line A-A.

The coil 171 may be adapted to align itself during the opening/closing (or crimping) operations in any suitable fashion. For example, FIGS. 21 and 22 illustrate one example of how the coils may be aligned. In this example, a first end 191 of the coil 171 comprises a receiving area 193. The receiving area 193 is suitably sized and shaped to receive a second end 195 of the coil 171. However, any suitable configuration may be provided. As the indentors 173, 175, 177, 179 move from the open position to the closed position (or vice versa), the second end 195 of the coil 171 may slide in/out of the receiving area 193.

Figure 23:
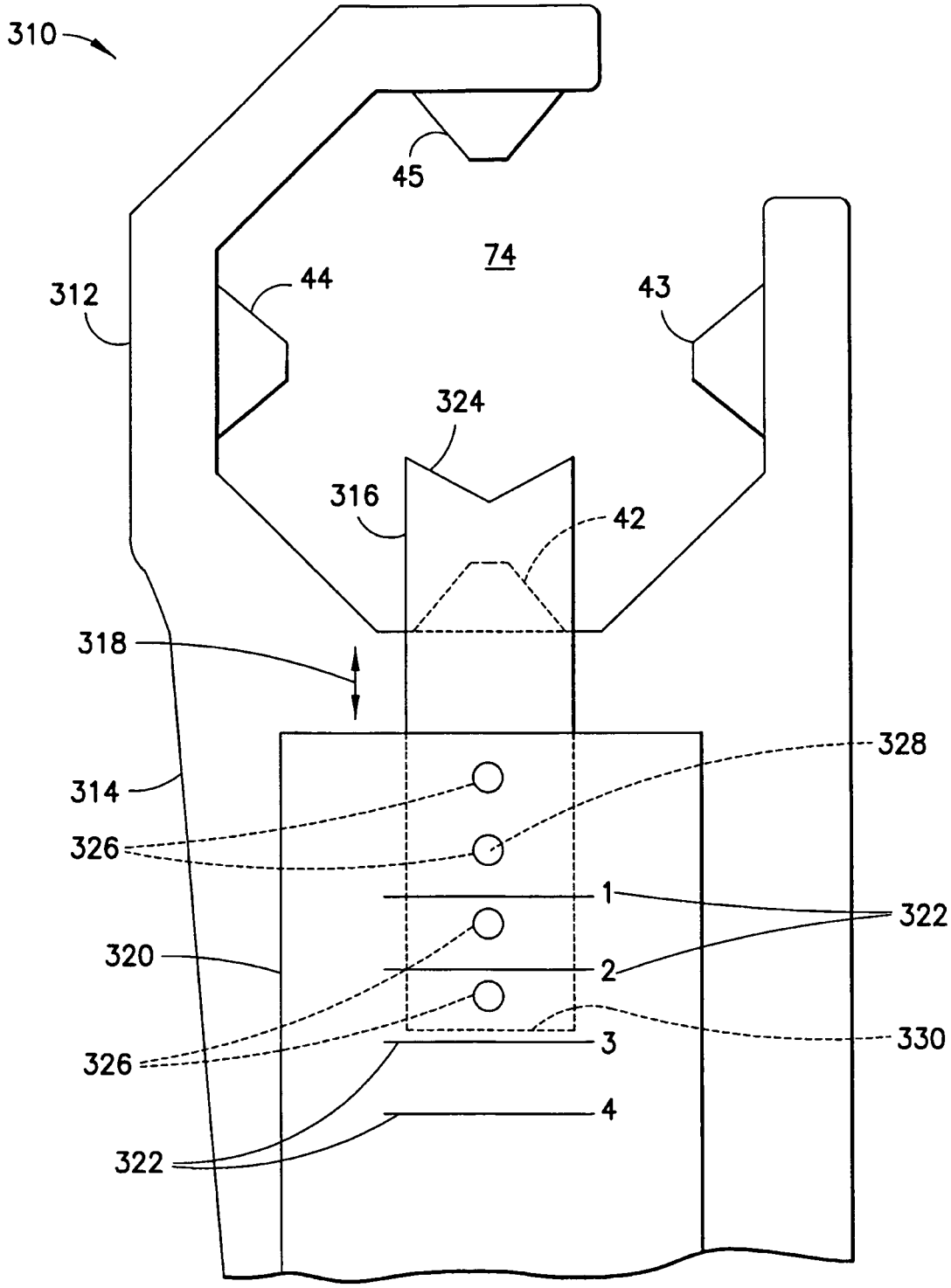
FIG. 23 is a front view of a working head assembly in accordance with another embodiment of the invention.

Referring now also to FIG. 23 another embodiment of the invention is shown. In this embodiment the working head 312 of the tool 310 has a frame 314 and indentors 42, 43, 44, 45 substantially the same as that shown in FIGS. 12-13. However, the working head includes a movable connector guide 316. The guide is slidably connected to the frame 314 for up and down movement as indicated by arrow 318. In this embodiment the guide 316 is slidably mounted behind a substantially transparent frame piece 320. The frame piece 320 includes indicia 322, such as color codes or notations for connector/conductor sizes to be crimped.

The guide 316 comprises a top end with a connector contact receiving seat (or connector receiving portion) 324. The connector receiving portion 324 is substantially aligned (or in positional agreement) with the receiving area 74 of the working head 312. The guide 316 comprises apertures or dimple indentations 326. The frame 314 comprises a protrusion 328 which is sized and shaped to be received in one of the indentations 326. When the guide 316 is slid up and down, the user can locate the bottom end 330 of the guide at one of the indicia 322. The protrusion 328 will be received in one of the indentations 326 to act as a detent lock. The engagement between the indentation 326 and protrusion 328 can be overcome with one or both resiliently deflecting when the user positively moves the guide 316. In a preferred embodiment the working head 312 could be adaptable to allow the guide 316 to be mounted on either side of the working head; such as based upon user preference.

Figure 24:
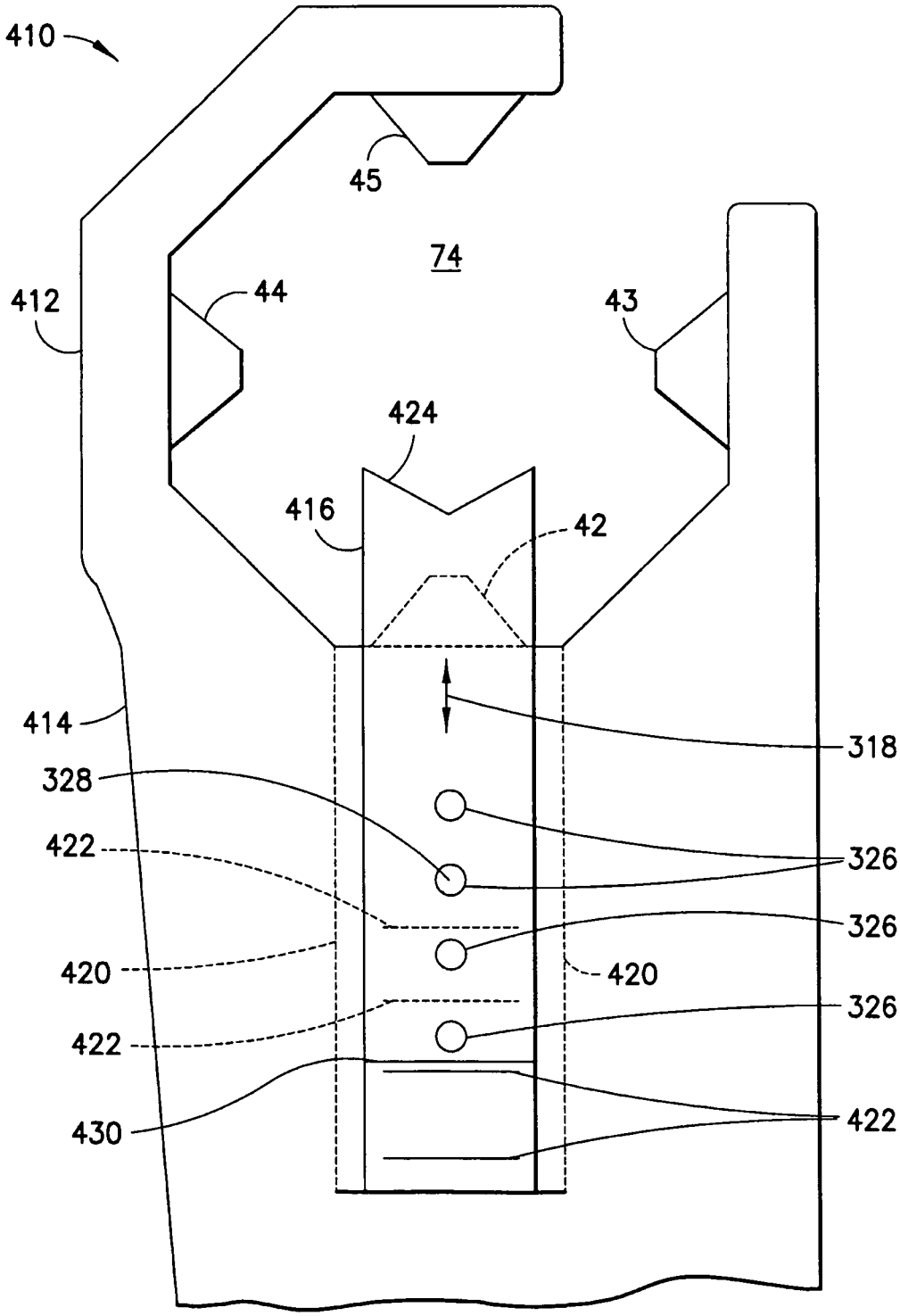
FIG. 24 is a front view of a working head assembly in accordance with another embodiment of the invention.

Referring also to FIG. 24, another embodiment of the invention similar to the embodiment shown in FIG. 23 is shown. In this embodiment the guide 416 has a different shaped connector contact receiving seat 424. This illustrates that any suitable shape for the connector contact receiving seat of the guide could be provided. In this embodiment the working head 412 of the tool 410 has a frame 414 and indentors 42, 43, 44, 45 substantially the same as that shown in FIGS. 12-13. The guide 416 is slidably connected to the frame 414 for up and down movement as indicated by arrow 318. In this embodiment the guide 316 is slidably mounted in a track or keyway 420 of the frame 414. The frame 414 includes indicia 422, such as color codes or notations for connector/conductor sizes to be crimped. The indicia 422 (except for the bottom most indicia) can be seen only when the bottom end of the guide is moved upward to uncover the indicia.

The guide 416 comprises apertures or dimple indentations 326. The frame 414 comprises a protrusion 328 which is sized and shaped to be received in one of the indentations 326. When the guide 416 is slid up and down, the user can locate the bottom end 430 of the guide at one of the indicia 422 and the protrusion 328 will be received on one of the indentations 326 to act as a detent locking means. The engagement between the indentation 326 and protrusion 328 can be overcome with the guide or the protrusion resiliently deflecting when the user positively moves the guide 416. In a preferred embodiment the working head 412 could be adaptable to allow the guide 416 to be mounted on either side of the working head; such as based upon user preference.

While various embodiments of the invention have been described in connection with tools having four indentors, one skilled in the art will appreciate that the invention is not necessarily so limited and that any suitable number of indentors may be provided. It should also be noted that the various embodiments of the invention are not limited to hydraulically operated crimping tools, as the various embodiments may be provided for any suitable type of tool which may benefit from a guide configuration for aligning a member within the tool.

According to one example of the invention, a method of assembling a hydraulic tool working head assembly is disclosed. The method includes the following steps. Providing hydraulic tool working head comprising an electrical connector receiving area. Attaching a guide to a first outer surface of the hydraulic tool working head, wherein the guide comprises a main section having a general plate shape and a slot, wherein the slot extends from a side edge of the main section, wherein the slot comprises a closed end at a middle portion of the main section, wherein the closed end is adapted to be aligned with the electrical connector receiving area, and wherein the slot is adapted to substantially center an electrical connector in the electrical connector receiving area. It should be noted that any of the above steps may be performed alone or in combination with one or more of the steps.

According to another example of the invention, a method of manufacturing a hydraulic tool working head guide is disclosed. The method includes the following steps. Providing a first section having a general plate shape, wherein the first section is adapted to be connected to an exterior surface of a hydraulic tool working head. Providing a first receiving area at the first section, wherein the first receiving area comprises an open end at an edge of the first section and a closed end at a middle portion of the first section, wherein the first receiving area extends through a thickness of the first section, wherein the closed end is adapted to be aligned with a connector receiving area of the hydraulic tool working head, and wherein the first receiving area is adapted to substantially center a connector in the connector receiving area. It should be noted that any of the above steps may be performed alone or in combination with one or more of the steps.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. A hydraulic tool working head guide comprising a main section having a general plate shape, wherein the main section comprises a plastic material, wherein the main section of the hydraulic tool working head guide is adapted to be connected to an exterior surface of a "C" type working head, wherein the main section comprises a slot having an open end at an edge of the main section and a closed end at a middle portion of the main section, wherein the slot extends through a thickness of the main section, wherein the closed end comprises a substantial racetrack shape, wherein the closed end is adapted to be aligned with a receiving area of the hydraulic tool working head, and wherein the slot is adapted to substantially center a connector and/or a conductor in the receiving area.

2. A hydraulic tool working head guide as in claim 1 further comprising at least one guide fastener adapted to be removably connected to a hydraulic tool working head fastener, and wherein the at least one guide fastener is directly attached to the hydraulic tool working head guide.

3. A hydraulic tool working head guide as in claim 1 wherein the open end is adapted to be aligned with a connector entry/exit slot of the hydraulic tool working head, wherein the guide comprises thickened section, and wherein at least a portion of the thickened section is adapted to extend into the receiving area.

4. A hydraulic tool working head guide as in claim 1 wherein a portion of the main section is between the closed end and the edge.

5. A hydraulic tool working head guide as in claim 1 wherein the main section further comprises indicia or markings corresponding to a connector size, and wherein the main section is adapted to be connected to the exterior surface of the "C" type working head.

6. A hydraulic tool working head guide comprising a main section having a general plate shape, wherein the main section of the hydraulic tool working head guide is adapted to be connected to an exterior surface of a latch type hydraulic tool working head, wherein the main section comprises a slot having an open end at an edge of the main section and a closed end at a middle portion of the main section, wherein the slot extends through a thickness of the main section, wherein the closed end is adapted to be aligned with a receiving area of the hydraulic tool working head, and wherein the slot is adapted to substantially center a connector and/or a conductor in the receiving area.

7. A hydraulic tool working head comprising:

a main frame having a receiving area;

at least two indentors connected to the main frame, wherein the at least two indentors are proximate the receiving area and; and a hydraulic tool working head guide connected to the main frame, wherein the hydraulic tool working head guide comprises a main section having a general plate shape, wherein the main section of the hydraulic tool working head guide is adapted to be connected to an exterior surface of a "C" type or latch type hydraulic tool working head, wherein the main section comprises a slot having an open end at an edge of the main section and a closed end at a middle portion of the main section, wherein the slot extends through a thickness of the main section, wherein the closed end is adapted to be aligned with a receiving area of the hydraulic tool working head, and wherein the slot is adapted to substantially center a connector and/or a conductor in the receiving area.

8. A hydraulic tool working head comprising:

a main frame comprising a first exterior side, a second exterior side, and a connector receiving area, wherein the first exterior side is opposite the second exterior side, and wherein the connector receiving area extends between the first exterior side and the second exterior side; and a guide mounted on the first exterior side, wherein the guide comprises a connector receiving portion in positional agreement with the connector receiving area, wherein the connector receiving portion is adapted to align an electrical connector in the receiving area, and wherein the guide is slidably connected to the main frame.

9. A hydraulic tool working head as in claim 8 wherein the guide comprises apertures or dimple indentations.

10. A hydraulic tool working head as in claim 9 wherein the main frame comprises a protrusion adapted to engage with one of the apertures or dimple indentations.

11. A hydraulic tool working head as in claim 8 wherein the main frame comprises indicia or markings, wherein the indicia or markings correspond to a position of the guide.

12. A hydraulic tool working head as in claim 8 wherein the connector receiving portion comprises a receiving seat.

13. A hydraulic tool working head as in claim 8 wherein guide comprises a general plate shape.

14. A hydraulic tool working head guide comprising:

a first section having an opening, wherein the first section is adapted to be connected to a hydraulic tool working head; and a second section comprising at least one spring arm, wherein the spring arm extends away from the first section of the hydraulic tool working head guide, wherein the spring arm is adapted to extend into a connector receiving area of the hydraulic tool working head, and wherein the spring arm is adapted to contact and substantially center a connector in the receiving area.

15. A hydraulic tool working head guide as in claim 14 wherein the first section comprises a general "C" or "U" shaped cross section.

16. A hydraulic tool working head guide as in claim 14 wherein the first section is adapted to clip on to an anvil section of the hydraulic tool working head.

17. A hydraulic tool working head guide as in claim 14 wherein the opening is adapted to accommodate an indentor of the hydraulic tool working head.

18. A hydraulic tool working head guide as in claim 14 wherein the second section further comprises at least two spring arms, wherein the at least two spring arms form a connector receiving area having a general "V" shape.

19. A hydraulic tool working head comprising:

a main frame having an anvil section and a receiving area;

at least two indentors connected to the main frame, wherein the at least two indentors are proximate the receiving area and; and a hydraulic tool working head guide as in claim 14 connected to the anvil section.

20. A hydraulic tool working head comprising:

a main frame comprising a first exterior side, a second exterior side, and a connector receiving area, wherein the first exterior side is opposite the second exterior side, and wherein the connector receiving area extends between the first exterior side and the second exterior side;

a first indentor at the receiving area, wherein the first indentor is movably connected to the main frame, and wherein the first indentor comprises a first opening;

a second indentor at the receiving area, wherein the second indentor is movably connected to the main frame, and wherein the second indentor comprises a second opening; and a coil extending through the first opening and the second opening, wherein the coil is adapted to center an electrical connector in the receiving area.

21. A hydraulic tool working head as in claim 20 wherein the coil is adapted to feed through first opening and the second opening when the indentors move from an open position to a closed position.

22. A hydraulic tool working head as in claim 20 wherein the coil is adapted to locate the electrical connector between the indentors and away from a miss-crimp area of the hydraulic tool working head.

* * * * *